US005263211A

United States Patent [19]

Grant

[11] Patent Number: 5,263,211

[45] Date of Patent: Nov. 23, 1993

[54] FULL TUCK BED SHEET WITH FLUID MATTRESS AND METHOD OF MAKING

[76] Inventor: Benton H. Grant, 126 Chestnut Hill Rd., Stamford, Conn. 06903

[21] Appl. No.: 874,363

[22] Filed: Apr. 27, 1992

[51] Int. Cl.[5] ..... A61G 7/057; A47C 27/10

[52] U.S. Cl. ..... 5/456; 5/453; 5/903; 128/33; 156/145; 156/290; 156/292; 156/289

[58] Field of Search ..... 5/453, 455, 456, 482, 5/421, 903; 156/145, 292, 290, 289; 128/33

[56] References Cited

U.S. PATENT DOCUMENTS

| | | | |
|---|---|---|---|
| 211,741 | 1/1879 | Johnson . | |
| 2,913,861 | 11/1959 | MacNeale . | |
| 3,199,124 | 8/1965 | Grant | 5/453 |
| 3,332,415 | 7/1967 | Erickson | 128/87 |
| 3,467,081 | 9/1969 | Glass | 5/453 |
| 3,467,974 | 9/1969 | Deutsch | 5/502 |
| 4,042,988 | 8/1977 | Holliday | 5/450 |
| 4,267,611 | 5/1981 | Agulnick | 5/453 |
| 4,454,615 | 6/1984 | Whitney | 5/449 |
| 4,461,048 | 7/1984 | Allaire, Jr. | 5/497 |
| 4,917,646 | 4/1990 | Kieves | 446/224 |
| 4,924,541 | 5/1990 | Inagaki | 5/468 |
| 4,962,546 | 10/1990 | Vitale | 5/497 |
| 5,103,518 | 4/1992 | Gilroy et al. | 5/453 |

*Primary Examiner*—Alexander Grosz

*Attorney, Agent, or Firm*—St. Onge Steward Johnston & Reens

[57] ABSTRACT

A bed sheet is provided comprising first and second layers of fluid impervious material a portion of which are overlapped for sealing together to form sets of fluid cells, and lateral flap portions extending smoothly and substantially without wrinkles from the overlapped portion for tucking around the sides and beneath the bed. Preferably, the fluid cells formed according to a pattern such that the lateral flap portions remain substantially without wrinkles upon introduction of fluid to said fluid cells. Preferably, the lateral flap portions are formed from the first and second layers and most preferably from the non-overlapped portions. Preferably, the bed sheet fluid cells are connectable to fluid lines by a flexible fluid line patch having fluid line connectors sealed thereinto. The fluid line patch may be presealed from overlapped swatches of fluid impervious material along a second line to form first and second fluid passages and seal first and second fluid line connectors thereto. In another aspect, the invention comprises a method of making the bed sheet including the steps of overlapping a portion of the first and second layers to form an overlapped portion and lateral flap portions, and sealing the layers together along a line to form the fluid cells in the overlapped portion.

11 Claims, 5 Drawing Sheets

FULL TUCK BED SHEET WITH FLUID MATTRESS AND METHOD OF MAKING

FIELD OF THE INVENTION

The invention relates to bed sheets which comprise an fluid mattress for tucking around the sides of a conventional mattress, and to methods of making such bed sheets. The bed sheet aids in preventing soilage and dampening of the conventional mattress, and in retaining the fluid mattress in position upon the conventional mattress.

BACKGROUND OF THE INVENTION

It is well known that patients who lie for long periods of time on a flat mattress develop bed sores where pressure points occur between bony structures and the mattress. To alleviate this condition without acquiring a great deal of nursing time for turning the patient manually, alternating pressure point mattresses are known wherein two sets of interdigitated cells are provided in the hollow mattress, alternating ones of which are inflated while those between are deflated and this cycle is regularly repeated between the two sets of cells so that alternately one set or the other is supporting the patient.

Prior art hollow mattresses of this type are usually manufactured by forming the interdigitated cells in a first step and then in a second step by hand sealing rigid air conduits in a side of the mattress. This manufacturing process can be inefficient because it requires hand manipulation of a rather large hollow mattress in order to hand seal the rigid air conduits. Apart from being cumbersome, the hand manipulation may damage a partially made mattress. Further, the rigid conduits tend to protrude from the sealed edge of the hollow mattress and may impede bed making or poke a user of the mattress.

End flaps, as disclosed in U.S. Pat. No. 3,199,124, are also known for holding the hollow mattress in position on a bed, usually on top of an ordinary mattress. The end flaps serve to tuck under the head and foot of the bed to retain the hollow mattress in place, for example, when the bed is gatched. The known end flaps are provided as separate pieces of material secured to a hollow mattress. The flaps are attached along an edge including alternating ones of chambers from the two different sets. A length of edges of the hallow mattress which include alternating ones of air chambers, substantially shrinks upon inflation, wrinkling and distorting the flaps attached to such edges. Wrinkled end flaps are disadvantageously difficult to tuck and do not sufficiently retain the hollow mattress in position on the bed, for example, when a patient moves into or out of bed.

The known method of manufacturing a hollow mattress with end flaps is to secure the end flaps to the mattress while forming the interdigitated cells. This manufacturing process is inefficient because of the added step of aligning the end flaps with the hollow mattress, and because the addition of end flaps increases the size of the mattress and makes hand manipulation of the mattress for hand sealing of prior art rigid conduits even more cumbersome and inefficient.

Corner tapes or straps, such as those disclosed in U.S. Pat. Nos. 3,467,081 and 4,454,615, are also known for holding an inflatable mattress in position on a bed. Such straps, however, are typically attached to the mattress in a more or less point contact and thus the entire securement load is borne by the points at which the straps are connected. This type of prior art mattress disadvantageously impairs bed making and bed changing, because the securement straps are somewhat difficult and cumbersome to secure about the corners of the mattress. The straps also tend to tear away from the air mattress, rendering them useless and possibly puncturing the mattress. Manufacture of this type of inflatable mattress is inefficient because it requires the additional step of die cutting the straps or attaching the corner tapes and reinforcing gussets.

SUMMARY OF THE INVENTION

It is accordingly an object of the invention to provide a fluid mattress which is relatively easy to manufacture and use. It is another object of the invention to provide a bed sheet comprising an fluid mattress. It is still another object of the invention to provide a bed sheet having a fluid mattress with lateral portions that aid in retaining the fluid mattress in position upon a conventional mattress. It is yet another object of the invention to provide a bed sheet having a fluid mattress with relatively flexible conduits. It is yet still another object of the invention to provide a fluid mattress which aids in preventing soilage and dampening of a conventional mattress. It is still yet another object of the invention to provide a fluid mattress having smooth tucking flaps. It is yet still another object of the invention to provide a fluid mattress manufactured such that the fluid line connectors are simultaneously sealed to the mattress with formation of the fluid cells.

These and other objects are achieved by provision of a bed sheet comprising first and second layers of fluid impervious material a portion of which are overlapped for sealing together to form sets of fluid cells, and lateral flap portions extending smoothly and substantially without wrinkles from the overlapped portion for tucking around the sides and beneath the bed to aid in retaining the fluid cells upon the bed and to aid in preventing dampening and soiling of the bed, the fluid cells formed according to a pattern such that the lateral flap portions remain substantially without wrinkles upon introduction of fluid to said fluid cells.

Preferably, the lateral flap portions are formed from the first and second layers and most preferably from the non-overlapped portions. In this regard and according to another aspect of the invention, the bed sheet is made according to a method comprising overlapping a portion of the first and second layers to form an overlapped portion and lateral flap portions, and sealing the layers together along a line to form the fluid cells in the overlapped portion. Preferably, the bed sheet fluid cells are connectable to fluid lines by a fluid line patch having fluid line connectors and sealed between the layers. In this regard, and according to another aspect of the invention, the fluid line connectors may be sealed in fluid communication with the fluid cells at the same time the fluid cells are formed in the overlapped portion of the layers, eliminating the prior art step of hand manipulating the formed fluid mattress to seal the fluid conduits into the fluid cells. Most preferably, the fluid line patch is flexible such that it and any attached fluid lines may be bent down the side or end and, if desired, beneath the mattress to improve the ease of bed making and to prevent the fluid conduits from possibly poking a patient.

The fluid line patch may be presealed from overlapped swatches of fluid impervious material along a second line to form first and second fluid passages and seal first and second fluid line connectors thereto. By inserting thermal insulators within the fluid passages, the fluid passages can be sealed into the fluid cells upon forming the fluid cells without sealing off the fluid passages to bring the fluid cells and fluid line connectors into fluid communication, i.e., an upper swatch of the fluid patch is sealed to an upper layer and a lower swatch is sealed to a lower layer but the swatches are not completely sealed together in the region of the fluid passages. In this regard, the swatches and layers are most preferably provided of the same material to improve sealing together thereof.

The invention and its particular features will become more apparent from the following detailed description when considered with reference to the accompanying drawings.

DETAILED DESCRIPTION OF THE INVENTION

Figure 1:
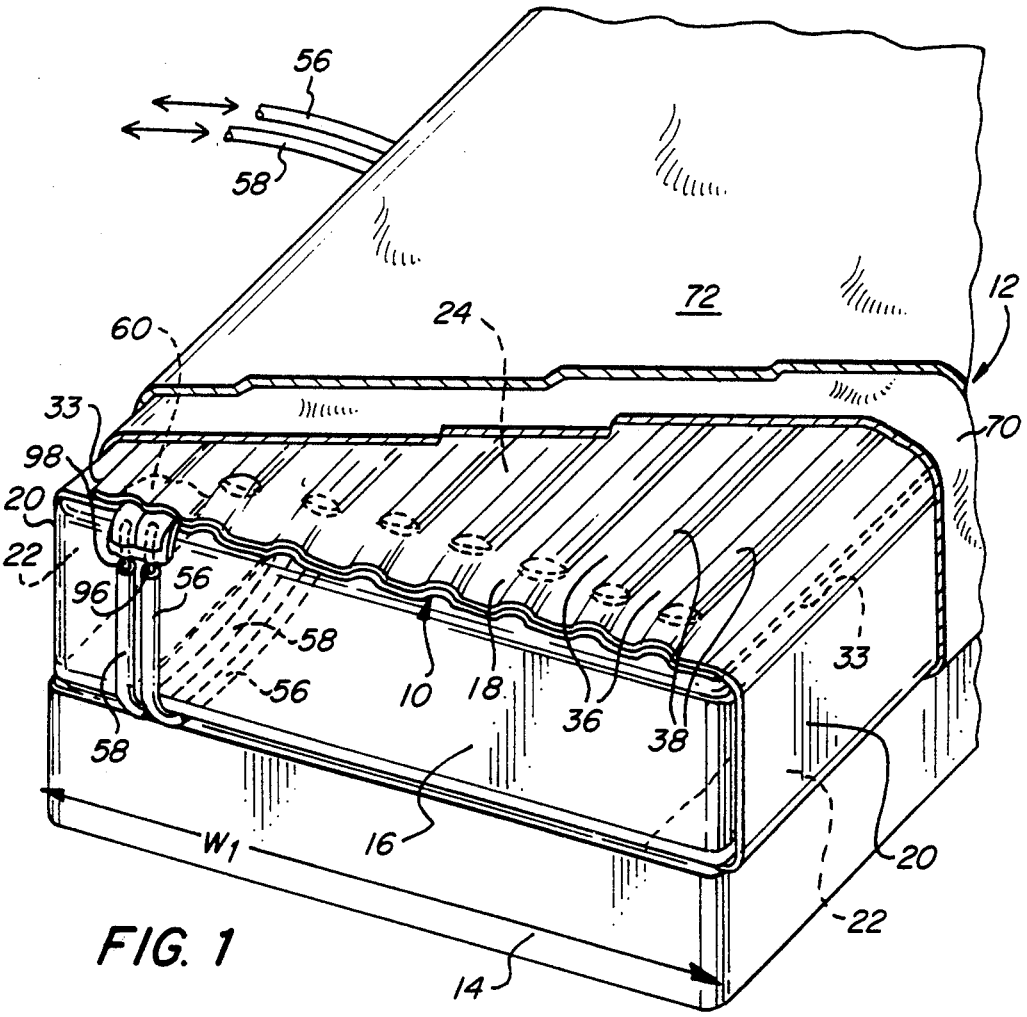
FIG. 1 is a partially cut away end perspective view of a bed sheet in accordance with the invention tucked around the sides of a conventional mattress, and with a flexible fluid line patch tucked around the end and beneath the mattress.

FIG. 1 depicts a bed sheet 10 in accordance with the invention in use on a bed 12. Bed 12 may but need not comprise a box spring 14, and comprises a mattress 16. Mattress 16 may be of conventional, futon or other style. Bed sheet 10 comprises a central overlapped portion 18 and lateral flap portions 20 for tucking around the sides 22 of mattress 16. Flap portions 20 aid in retaining central portion ia upon the top 24 of mattress 16 and also aid in preventing soilage and dampening of mattress 16. Prior art head and foot flaps, such as those disclosed in U.S. Pat. No. 3,199,124 have been somewhat effective for retaining an air mattress upon a bed as it is gatched. However, such flaps have been found to be less than effective for retaining the air mattress upon the bed as a patient is moved into or out of bed and for preventing soiling or dampening of sides 22 of the bed.

Figure 3:
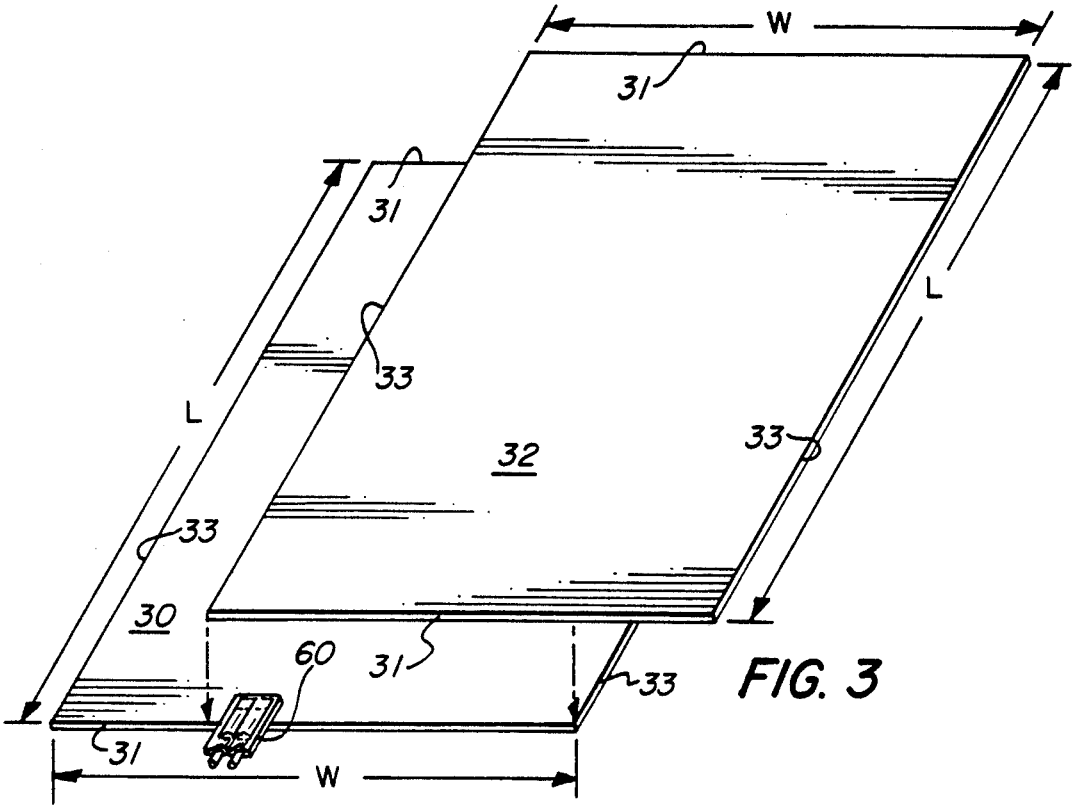
FIG. 3 is a partially exploded top perspective view of the bed sheet of FIG. I prior to sealing illustrating overlapping and sealing of the layers together with the fluid line patch.
Figure 4:
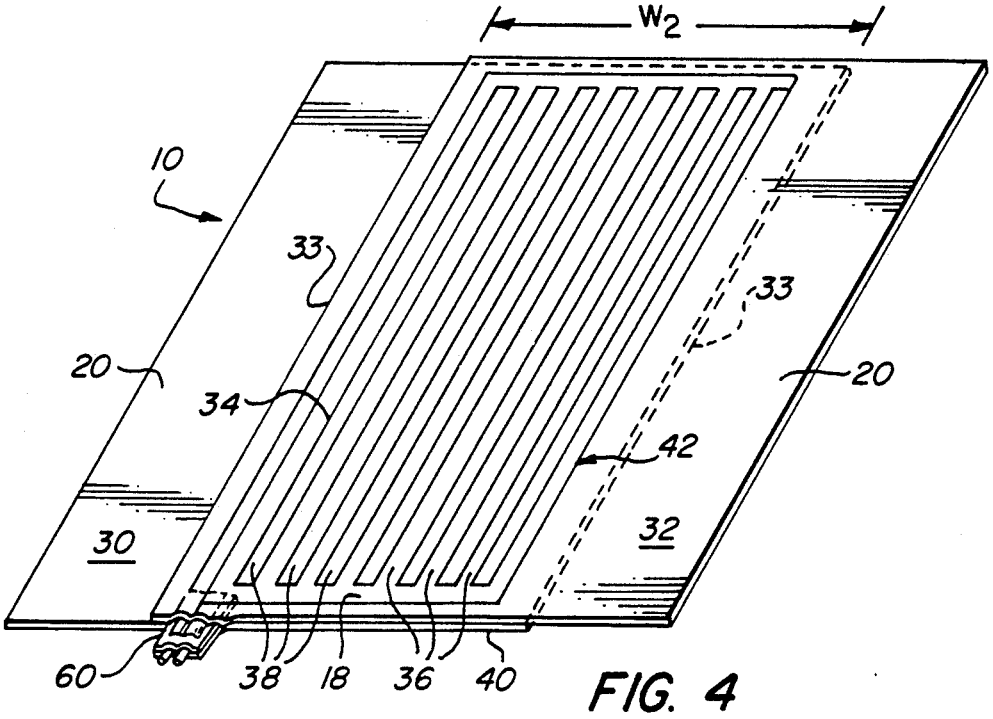
FIG. 4 is a top perspective view of the bed sheet of FIG. 1.

Referring to FIGS. 1, 3 and 4, bed sheet 10 is preferably formed from two layers 30, 32 of fluid impervious material each having a length L between end edges 31 and a width W between side edges 33. Length L is most preferably about equal to a length of mattress 16. Central portion 18 of bed sheet 10 is formed by overlapping layers 30, 32 along substantially their entire lengths for a portion $W_2$ of their overall widths W. In this regard, central portion 18 is bounded by end edges 31 of layers 30, 32 and by a single side edge 33 of each of layers 30, 32.

Flap portions 20 are defined by the region of each of layers 30, 32 extending beyond the side edge 33 of the other layer. Layers 30, 32 are sealed together along a line 34 in central portion 18 to form a plurality of fluid cells, preferably separated into first and second sets 36, 38 providing a fluid mattress 40. It is understood, however, that more or less sets of fluid cells are possible if desired. The fluid cells of set 36 are in fluid communication with each other, and the fluid cells of set 38 are in fluid communication with each other. Preferably, layers 30, 32 are sealed together along line 34 substantially simultaneously in a single step by a die or the like (not shown in any Figure).

Preferably, fluid cell sets 36, 38 are arranged in central portion 18 according to an interlocking, interdigitated, alternating or like pattern 42 such that individual ones of fluid cells from either of the sets 36, 38 are adjacent to, or lie along or lie substantially parallel to side edges 33 bounding central portion 18 of bed sheet 10. Thus, individual fluid cells are adjacent edges of fluid mattress 40 from which flap portions 20 extend. The advantage of this arrangement is that flap portions 20 may extend smoothly and substantially without wrinkles substantially regardless of the fluid pressure of fluid mattress 40 or state of introduction of fluid to cell sets 36, 38.

Figure 2:
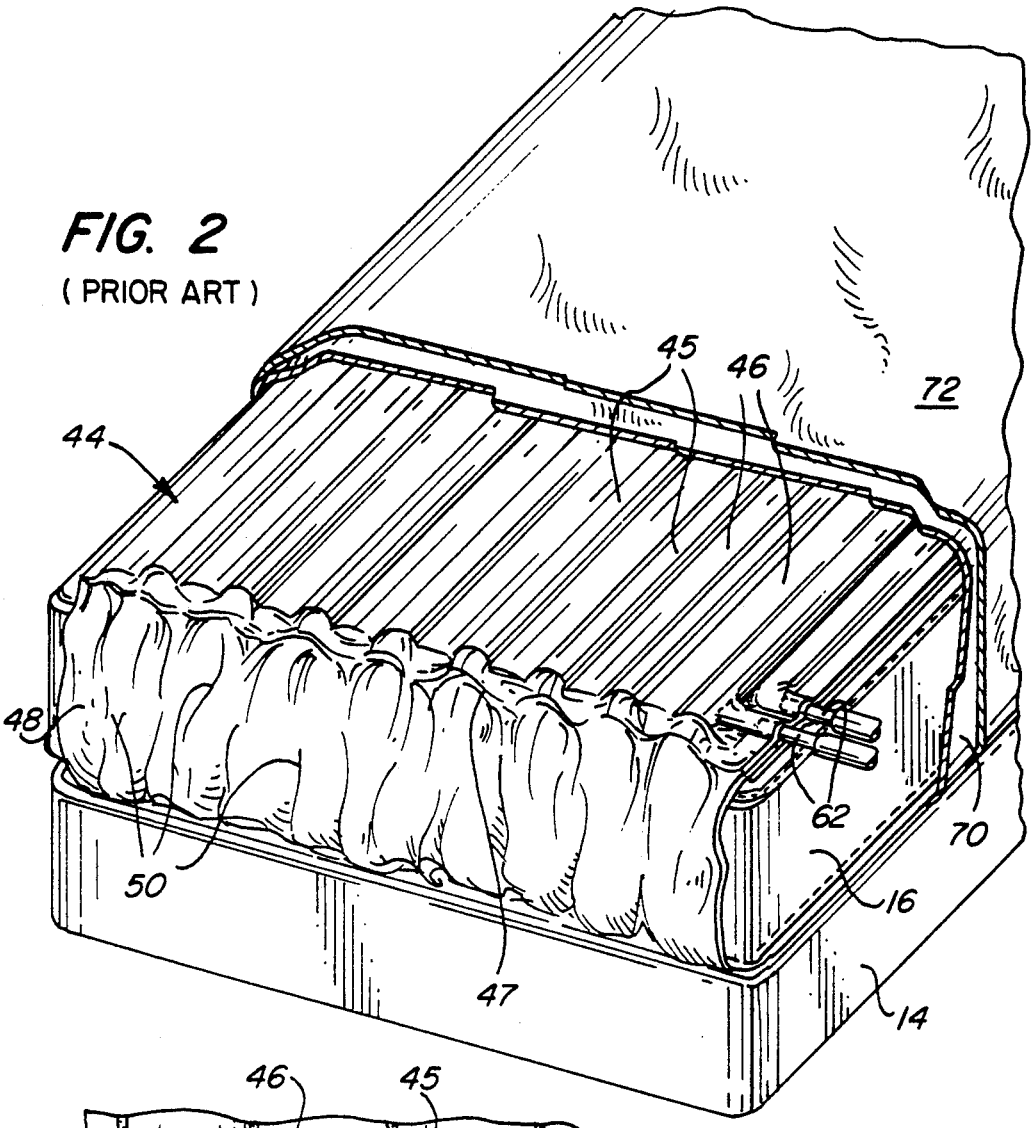
FIG. 2 ( PRIOR ART )
FIG. 2 is a partially cut away end perspective view of a prior art air mattress with wrinkled end flaps at the head and foot, and with rigid air conduits extending from a sealed edge thereof.

Referring to FIG. 2, in prior art hollow mattresses 44, such as that disclosed in U.S. Pat. No. 3,199,124, fluid cells 45, 46 were arranged with alternating ones of different sets or with a plurality of individual cells near or adjacent end edge 47 from which head and foot tucking flaps 48 extend. This arrangement of cells disadvantageously causes wrinkling 50 of flaps 48 upon inflation of the cells. Wrinkled flaps have been found to be more difficult to tuck and retain tucked. Further, according to the known method of manufacturing hollow mattress 44, flaps 48 were added as separate pieces to the mattress necessitating a cumbersome alignment step.

Returning to FIGS. 3 and 4, pattern 42 of fluid cell sets 36, 38 preferably provides alternating ones of fluid cells aligned adjacent or near at least one and most preferably near both end edges 31 of central portion 18 of fluid mattress 40 in order to maximize pressure point relief for patients.

Width $W_2$ of central portion 18 is preferably slightly greater than width $W_1$ of mattress 16 such that upon shrinkage of edges 31 bounding fluid mattress 40 due to introduction of fluid to cell sets 36, 38, the pressurized fluid mattress will have a width substantially equal to width $W_1$ of mattress 16 or other desired active area. For example, for a mattress having a width $W_1$ of 34 inches, overlapped portion 18 is preferably provided with an unpressurized width $W_2$ of 41 inches. In this regard, 60 inch width rolls of fluid impervious material (not shown in any Figures) may conveniently be used to provide layers 30, 32 with widths W of 60 inches to produce flap portions 20 having 19 inch widths ($W-W_2$). Upon pressurization, the width of fluid mattress 40 will shrink to about 34 inches ($W_1$), depending upon the number and dimension of fluid cells, providing bed sheet 10 with an overall width of about 72 inches (34+19+19) which is approximately the width of a standard sheet for a 34 inch wide hospital or twin bed. It is understood that other dimensions and ratios of $W_2$:$W_1$ are possible and readily may be determined.

Returning to FIG. 1, fluid cells of fluid cell set 38 are shown pressurized with fluid, preferably air, while fluid cells of fluid cell set 36 are shown relatively deflated. Pressurization and depressurization of fluid cell sets 36, 38 is achieved by fluid lines 56, 58 (as indicated by double ended arrows) respectively connected one each to fluid cell sets 36, 38 and to a fluid pump (not shown in any Figure). Timing of the pressurization and depressurization of fluid cell sets 36, 38 may be determined by a timer mechanism (also not shown in any Figure) used in conjunction with the fluid pump. See, e.g., my U.S. Pat. No. 5,009,579. Fluid lines 56, 58 are connected in fluid communication with fluid cell sets 36, 38 by a fluid line patch 60 assembled from relatively flexible fluid impervious material.

Figure 8:
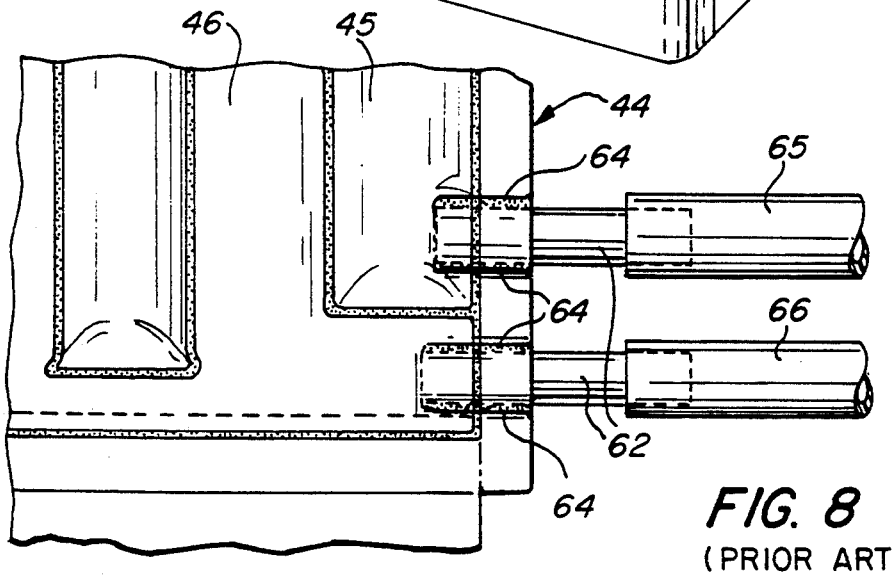
FIG. 8 (PRIOR ART)
FIG. 8 is an enlarged partial top plan view of the prior art air mattress of FIG. 2 illustrating the rigid conduits sealed to an edge thereof.

The flexibility of fluid line patch 60 offers advantages over prior art constructions. Referring briefly to FIG. 8, prior art hollow mattresses 44, such as those illustrated in U.S. Pat. No. 3,199,124, disadvantageously include relatively rigid conduits 62 directly sealed as indicated at 64 to an edge of the mattress for respectively connecting fluid lines 65, 66 to fluid cells 45, 46. Conduits 62 may poke or otherwise discomfort a user of hollow mattress 44. Further, because conduits 62 are relatively rigid and directly extend from a sealed edge of hollow mattress 44, it has been found that neither fitted sheet 70 nor standard sheet 72 properly and smoothly can be fitted and tucked over conduits 62 in bed making. Returning to FIG. 1, however, the relative flexibility of fluid line patch 60 permits it to bend-down around the side or end of mattress 16 for proper and smooth fitting and tucking of fitted sheet 70 and standard sheet 72 over fluid line patch 60 in bed making. Additionally, bending fluid line patch 60 down around mattress 16 permits fluid lines 56, 58 to traverse beneath mattress 16 (as indicated in dashed lines) to a position convenient to placement of the fluid pump (not shown in any Figure).

Figure 5:
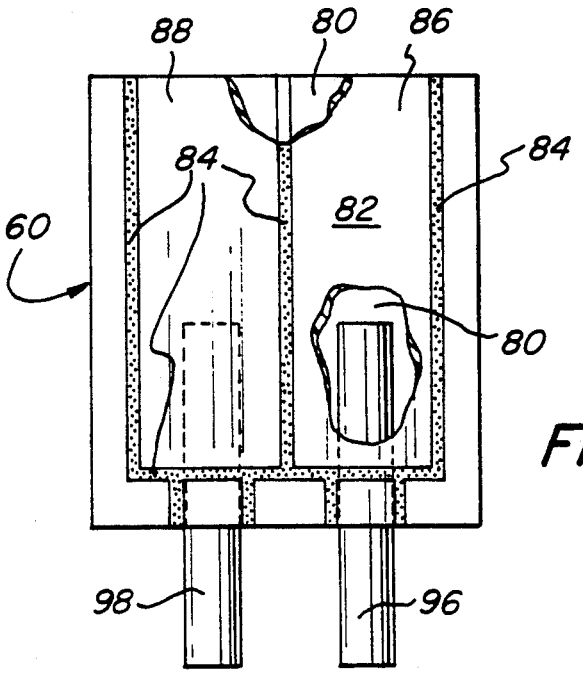
FIG. 5 is an enlarged plane view of the fluid line patch of the bed sheet of FIG. 1.

Referring now to FIG. 5, an enlarged top plan view provides additional detail of fluid line patch 60. Fluid, line patch 60 comprises overlying swatches 80, 82 of fluid impervious material, e.g. vinyl, sealed together along a line 84 to form fluid passages 86, 88 between swatches 80, 82, respectively. Sealed into fluid passages 86, 88 are fluid line connectors 96, 98 which may be provided for example as pieces of copper tube or pipe. Fluid line connectors 96, ga can be relatively easily sealed between flexible swatches 80, 82 because the swatches are small and relatively easily manipulated. In contrast, production of prior art hollow mattresses 44, such as are illustrated in U.S. Pat. No. 3,199,124 and FIGS. 2 and 8 herein, requires the relatively difficult and cumbersome manipulation of the entire mattress for sealing of rigid conduits 62 thereinto. In this regard, fluid line patches 60 are preferably preassembled with fluid line connectors 96, 98 prior to incorporation into bed sheet 10 in a single sealing step not requiring manipulation of the bed sheet.

Figure 7:
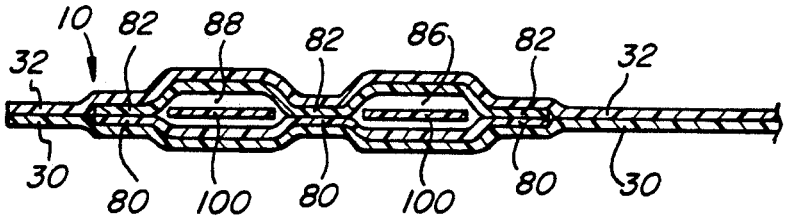
FIG. 7 is an enlarged partial end cross sectional view of the bed sheet of FIG. 1 taken along the plane 7—7 in FIG. 6.
Figure 6:
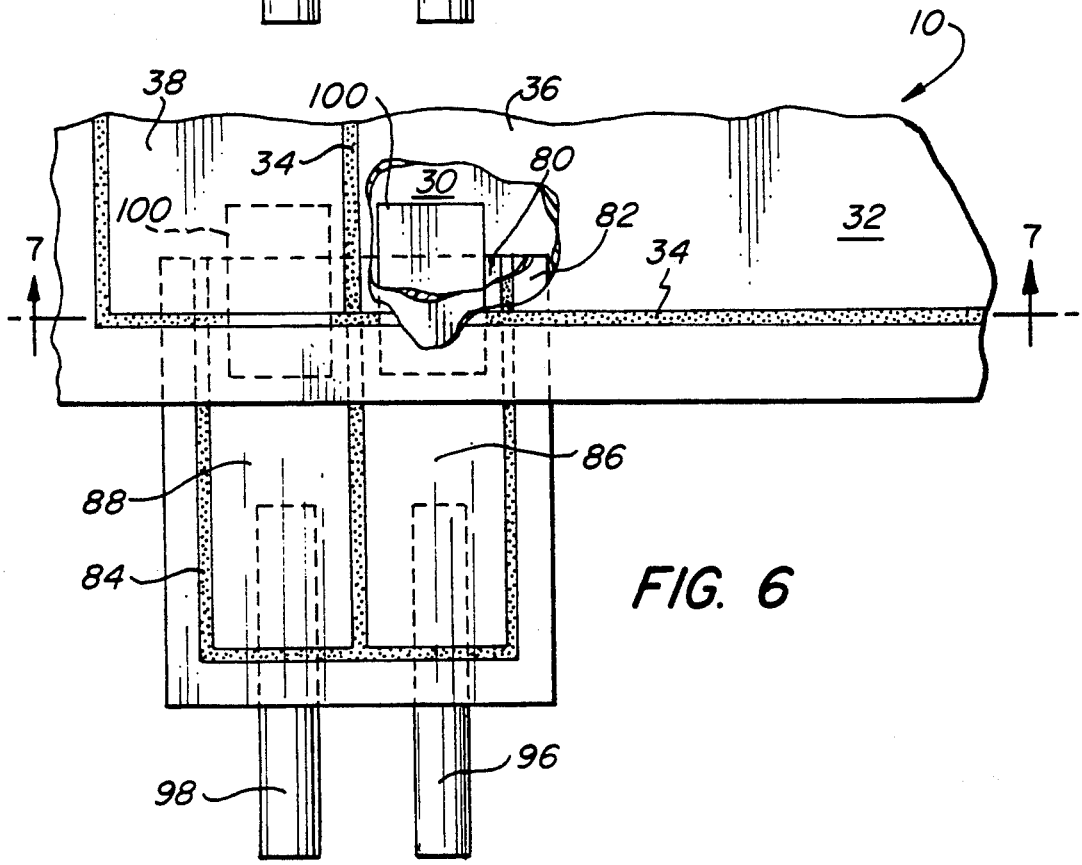
FIG. 6 is an enlarged partial plane view of the bed sheet of FIG. 1 illustrating sealing of the fluid line patch between the layers.

Returning briefly to FIGS. 3 and 4, fluid line patch 60 is preferably inserted and sealed between layers 30, 32 in a single step, most preferably substantially simultaneously by a die or the like, during sealing along line 34 to form fluid cell sets 36, 38. Referring now to FIGS. 6 and 7, fluid line patch 60 is sealed into bed sheet 10 such that fluid passage 88 is sealed into a cell of substantially simultaneously formed fluid cell set 38 and fluid passage 86 is sealed into a cell of substantially simultaneously formed, third cell set 36. In this regard, fluid line connectors 96, 98 are respectively placed in fluid line communication with fluid cell sets 36, 38.

Thermal inserts 100 prevent sealing along line 34 from sealing fluid passages 86, 88 closed. Traversing fluid line patch 60, all four plies of fluid impervious material (layers 30, 32 of mattress 40 and swatches 80, 82 of fluid line patch 60) are sealed together along sealing line 34 except in the region of thermal inserts 100. Thermal inserts 100 are placed within fluid passages 86, 88 prior to sealing fluid line patch 60 between mattress layers 30, 32 to prevent swatches 80, 82 from sealing together, while permitting swatch 80 to seal to layer 30 and swatch 82 to seal to layer 32 (see FIG. 7).

Figure 9:
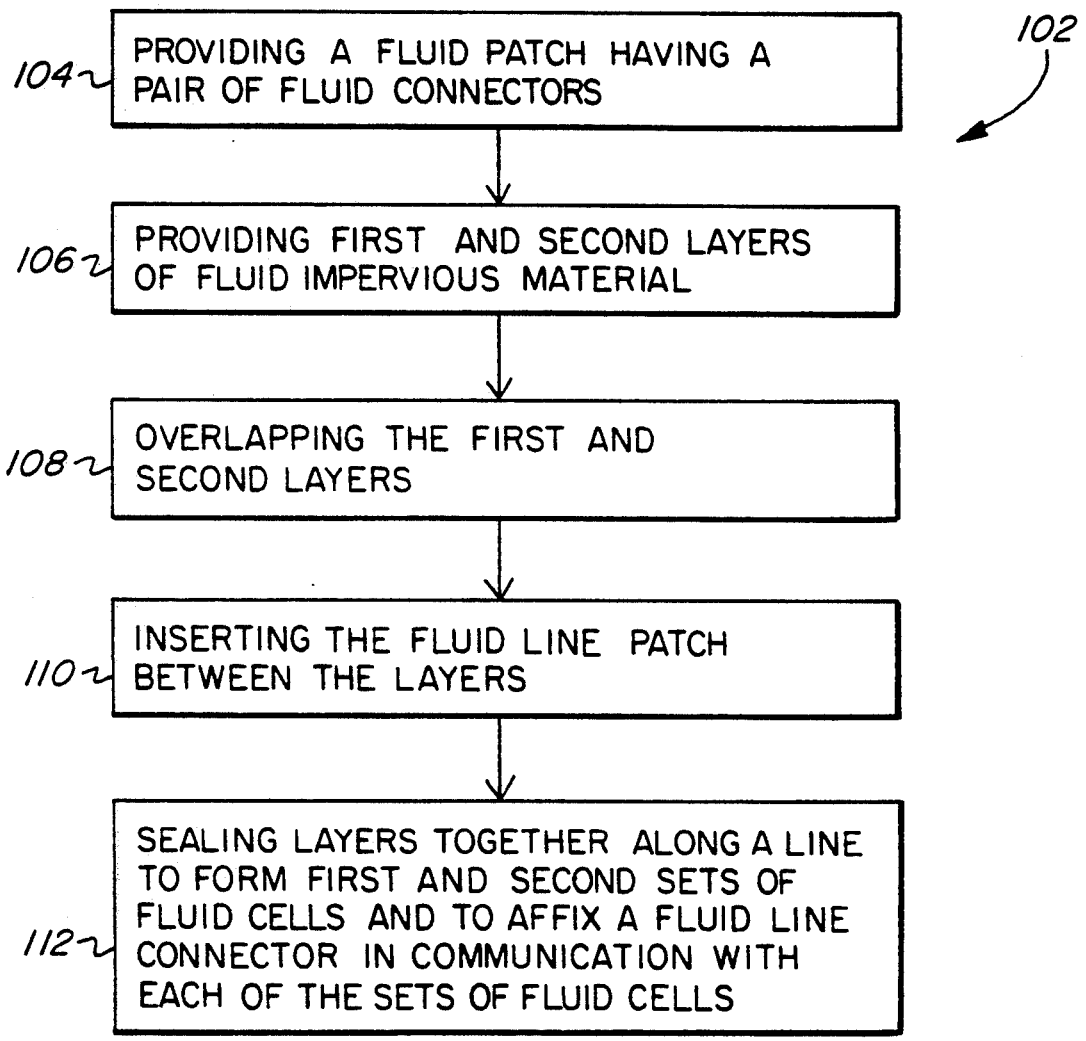
FIG. 9 is a block diagram illustrating a method of making the bedsheet of FIG. 1.

Referring finally to FIGS. 3, 4 and 9, bed sheet 10 is made according to a method 102 illustrated in FIG. 9. The first step in method 102 is providing at 104 a fluid line patch 60 having fluid line connectors 96, 98. Next, layers 30, 32 of fluid impervious material are provided at 106 and overlapped at 108. Fluid line patch 60 is inserted between layers 30, 32 at 110 and layers 30, 32 are sealed together along line 34 at 112 to form fluid cell sets 36, 38 and to affix fluid line connectors 96, 98 one each into fluid communication with a cell of fluid cell sets 36, 38. It is understood that the order in which the overlapping and inserting steps are carried out is not critical.

Although the invention has been described with reference to particular embodiments, features, and the like, these are not intended to exhaust all possible features and indeed many modifications and variations will be ascertainable to those of skill in the art.

What is claimed is:

1. A bed sheet for a mattress comprising:

first and second layers of fluid impervious material having a width between side edges and having a length between end edges equal to about a length of the mattress;

first and second sets of fluid cells formed from an overlapped portion of said layers, said fluid cells extending substantially the length of said layers;

first and second flap portions extending smoothly and substantially without wrinkles from the overlapped portion of said layers for a distance sufficient to tuck said flap portions around the sides and partially beneath the mattress to aid in retaining said central portion in position on the mattress and to aid in preventing dampening and soiling of the mattress, said flap portions remaining substantially without wrinkles upon introduction of fluid to said fluid cells;

the bed sheet formed according to a method comprising the steps of overlapping a portion of the width of said first layer with a portion of the width of said second layer to form said overlapped portion bounded by one side edge of each of said layers and by said end edges, and to form said flap portions from remaining portions of each of said layers extending beyond the side edges of the other of said layers, and sealing said layers together along a line to form said fluid cells in said overlapped portion according to a pattern such that individual ones of said fluid cells are individually disposed along the side edges of said layers and individual ones of said fluid cells are alternately disposed along the width of said layers.

2. A bed sheet according to claim 1 including a pair of fluid line connectors, a different one of said fluid line connectors affixed in fluid communication with each of said first and second fluid cells;

the bed sheet formed according to a method including the additional steps of inserting said fluid line connectors between said overlapped portion of said layers, and sealing a different one of said fluid line connectors in fluid communication with each of said fluid cells by sealing said first and second layers together along the line.

3. A bed sheet according to claim I including a flexible fluid line patch comprising upper and lower swatches of fluid impervious material;

first and second fluid passages formed in said swatches, a different one of said fluid passages fixed in fluid communication with each of said first and second fluid cells; and the bed sheet formed according to a method including the additional steps of inserting the fluid line patch between said overlapping portions of said layers, and sealing said fluid line patch between said layers by sealing said first and second layers together along the line such that a different one of said swatches is sealed to each of said layers without the upper and lower swatches being substantially sealed together in the region of said fluid passages.

4. A bed sheet according to claim 3 including a pair of fluid line connectors, a different one of said fluid line connectors affixed in fluid communication with each of said fluid passages; and the bed sheet formed according to a method including the additional steps of inserting said fluid line connectors between said swatches, forming said fluid passages in said fluid line patch by sealing said swatches together along a second line, and sealing a different of of said fluid line connectors into each of said fluid passages by sealing said swatches together along the second line.

5. A bed sheet according to claim 4 including a pair of thermal insulators, one of said thermal insulators located within each said fluid passages; and the bed sheet formed according to a method including, prior to sealing said fluid line patch between said layers, the additional step of inserting said thermal insulators one each within said fluid passages to permit sealing of a different one of said swatches respectively to a single one of said layers while preventing sealing together of said swatches in the region of said fluid passages.

6. A bed sheet for a mattress comprising:

first and second layers of fluid impervious material having a length between end edges equal to about a length of the mattress and having a width between side edges, said layers overlapping for a portion of their width a distance slightly greater than a width of the mattress to form a central overlapped portion defined by end edges of said layers and one side edge of each of said layers;

first and second sets of fluid cells formed in said overlapped portion by sealing said layers together along a line, said fluid cells of said first set in fluid communication, said fluid cells of said second set in fluid communication, said fluid cells extending substantially the length of said layers, said fluid cells arranged in a pattern such that individual ones of said fluid cells are individually disposed along said side edges and individual ones of said fluid cells are alternately disposed along at least one of said end edges; and remaining portions of the width of said layers forming first and second lateral portions extending one each from said side edges adjacent an individual one of said fluid cells, said lateral portions extending smoothly and substantially without wrinkles for a distance sufficient to tuck around the sides and partially beneath the mattress to aid in retaining said central portion in position on the mattress and to aid in preventing dampening and soiling of the mattress, said lateral portions remaining substantially without wrinkles upon introduction of fluid to said fluid cells.

7. A bed sheet according to claim 6 comprising a relatively small, flexible and easily manageable fluid line patch sealed between said layers along the line in a single step as said fluid cells are formed in said overlapped portion, said fluid line patch having a pair of fluid line connectors, a different one of said fluid line connectors sealed into each of said fluid cell sets when said fluid line patch is sealed between said layers.

8. A bed sheet according to claim 7 wherein said fluid line patch comprises upper and lower swatches of fluid impervious material sealed to form first and second fluid passages, and wherein said fluid line connectors are sealed between said swatches such that a different one of said fluid connectors is sealed into each of said fluid passages.

9. A bed sheet according to claim 8 wherein, in the region of said fluid passages, a different one of said swatches is sealed to each of said layers, but said swatches are not completely sealed together permitting ingress and egress of fluid from said fluid line connectors to said fluid cells.

10. A bed sheet according to claim 9 including inserts placed within said fluid passages which prevent sealing together of said swatches, but permit sealing of a different one of said swatches to each of said layers in the single step during the forming of said fluid cells in said overlapped portion.

11. A bed sheet according to claim 6 including a relatively small and easily manageable fluid line patch sealed between said layers along the line in a single step as said fluid cells are formed in said overlapped portion, said fluid line patch comprising upper and lower swatches of fluid impervious material sealed to form first and second fluid passages, a different one of said fluid passages sealed in fluid communication with each of said fluid cells when said fluid line patch is sealed between said first and second layers.

* * * * *